US012643010B2

(12) United States Patent
Kim et al.

(10) Patent No.: US 12,643,010 B2
(45) Date of Patent: Jun. 2, 2026

(54) FREEWHEEL ADJUSTABLE WHEELS AND FITNESS BIKE THEREWITH

(71) Applicant: LG Electronics Inc., Seoul (KR)

(72) Inventors: Min Seok Kim, Seoul (KR); Sunggyu Koh, Seoul (KR); Jong Kyu Ju, Seoul (KR); Jai Whan Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 194 days.

(21) Appl. No.: 18/714,753

(22) PCT Filed: Jun. 30, 2023

(86) PCT No.: PCT/KR2023/009215
§ 371 (c)(1),
(2) Date: May 30, 2024

(87) PCT Pub. No.: WO2024/025183
PCT Pub. Date: Feb. 1, 2024

(65) Prior Publication Data

US 2025/0032850 A1 Jan. 30, 2025

(30) Foreign Application Priority Data

Jul. 27, 2022 (KR) ..... 10-2022-0093477

(51) Int. Cl.
*A63B 22/06* (2006.01)
*A63B 21/00* (2006.01)
*A63B 21/005* (2006.01)

(52) U.S. Cl.
CPC ..... *A63B 22/0605* (2013.01); *A63B 21/0052* (2013.01); *A63B 21/157* (2013.01); *A63B 2022/0611* (2013.01)

(58) Field of Classification Search
CPC ..... A63B 21/0052; A63B 21/0056; A63B 22/0605; A63B 2022/0611; A63B 2022/0629
See application file for complete search history.

(56) References Cited

U.S. PATENT DOCUMENTS 12,220,613 B2 * 2/2025 Koh ..... A63B 21/157
2006/0169814 A1 * 8/2006 Ikuta ..... A01K 89/0117 242/295

(Continued)

FOREIGN PATENT DOCUMENTS

KR 10-2022-0046235 A 4/2022
WO WO-2023219212 A1 * 11/2023 ..... A63B 21/00192

*Primary Examiner* — Zachary T Moore
(74) *Attorney, Agent, or Firm* — Birch, Stewart, Kolasch & Birch, LLP

(57) ABSTRACT

Disclosed herein are a freewheel adjustable wheel and a fitness bike therewith. The freewheel adjustable wheel according to the present disclosure comprises a rotation gear part being rotatably disposed outside a shaft, a spline gear rotating together with the rotation gear part, a fixation case which rotatably supports the rotation gear part and a rotation of which is restricted, a rotation case receiving power of the rotation gear part to rotate, a clutch bearing transferring power at a time when the rotation gear part rotates forward, a first gear part receiving power thought the clutch bearing, a driving part being fixed to the fixation case and providing rotational power, and a movement gear part operating in a non-freewheel mode where the movement gear part engages with the first gear part, and in a freewheel mode where the movement gear part is spaced from the first gear part.

20 Claims, 12 Drawing Sheets

(56) References Cited

U.S. PATENT DOCUMENTS

| | | | | |
|---|---|---|---|---|
| 2018/0009608 | A1* | 1/2018 | Danner | E05F 15/603 |
| 2020/0353310 | A1* | 11/2020 | Bissonnette | A63B 22/0005 |
| 2021/0169725 | A1* | 6/2021 | Baldwin | A61H 1/005 |
| 2023/0302324 | A1* | 9/2023 | Hall | A63B 21/015 |

* cited by examiner

[Fig. 1]
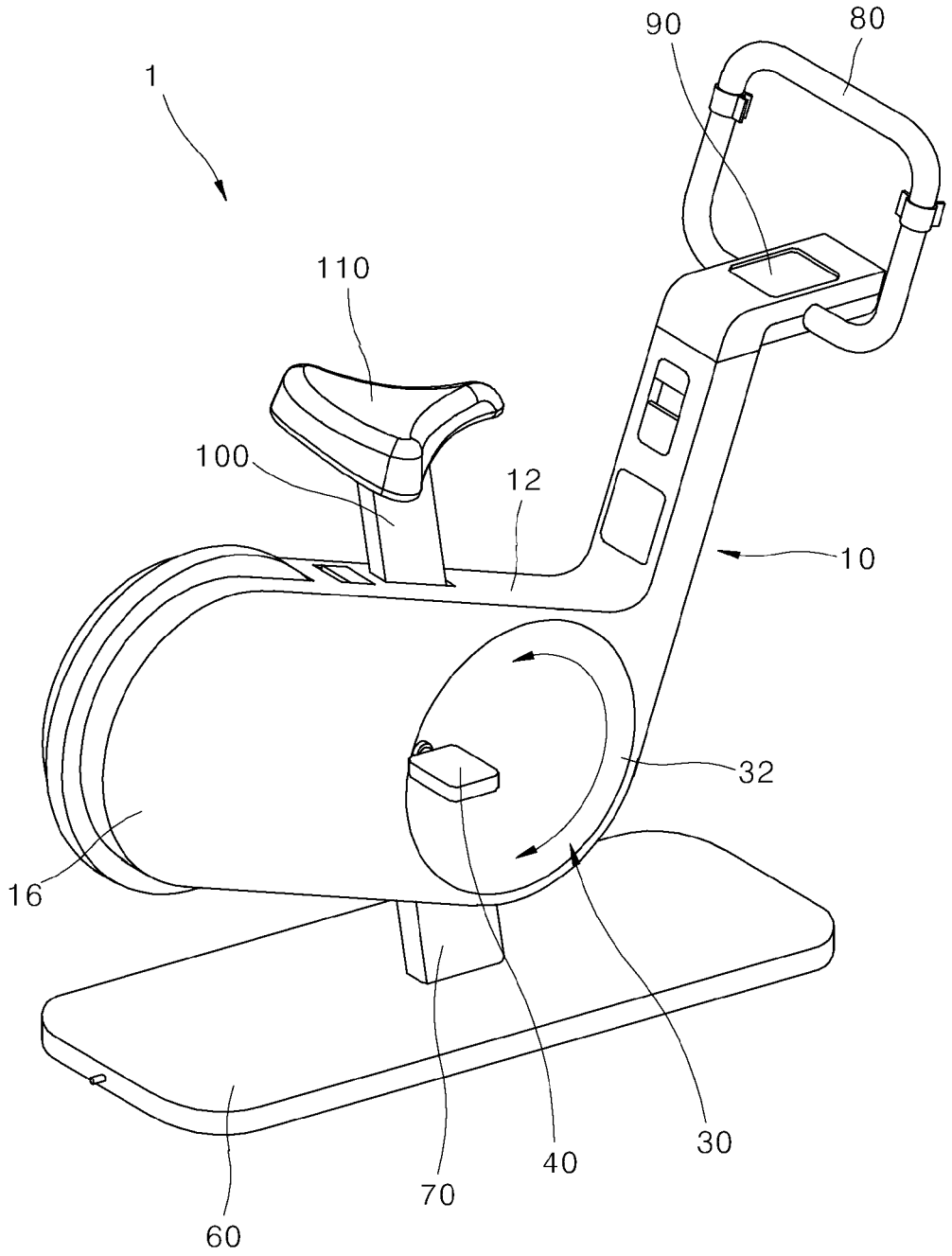

[Fig. 2]
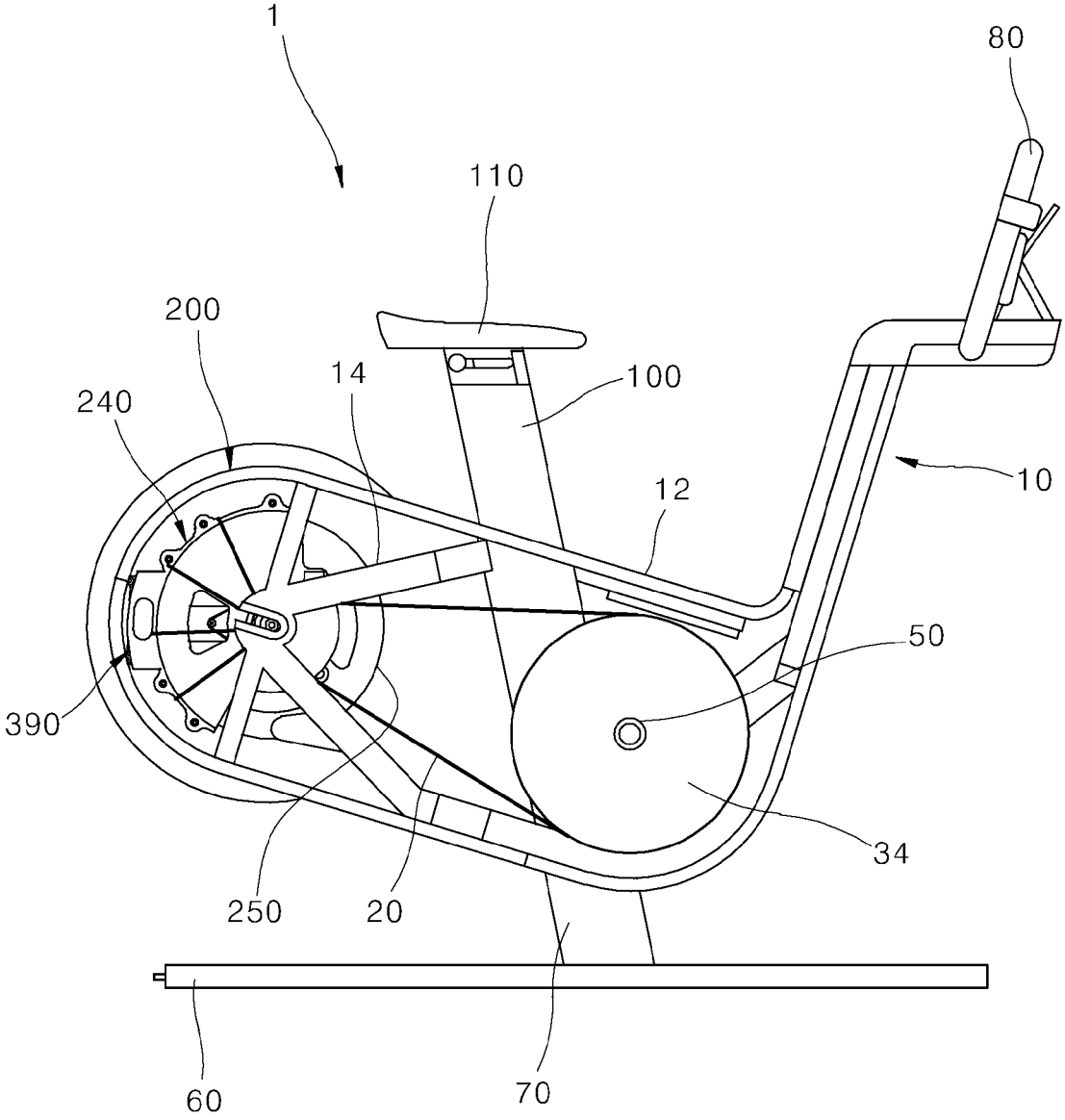

[Fig. 3]
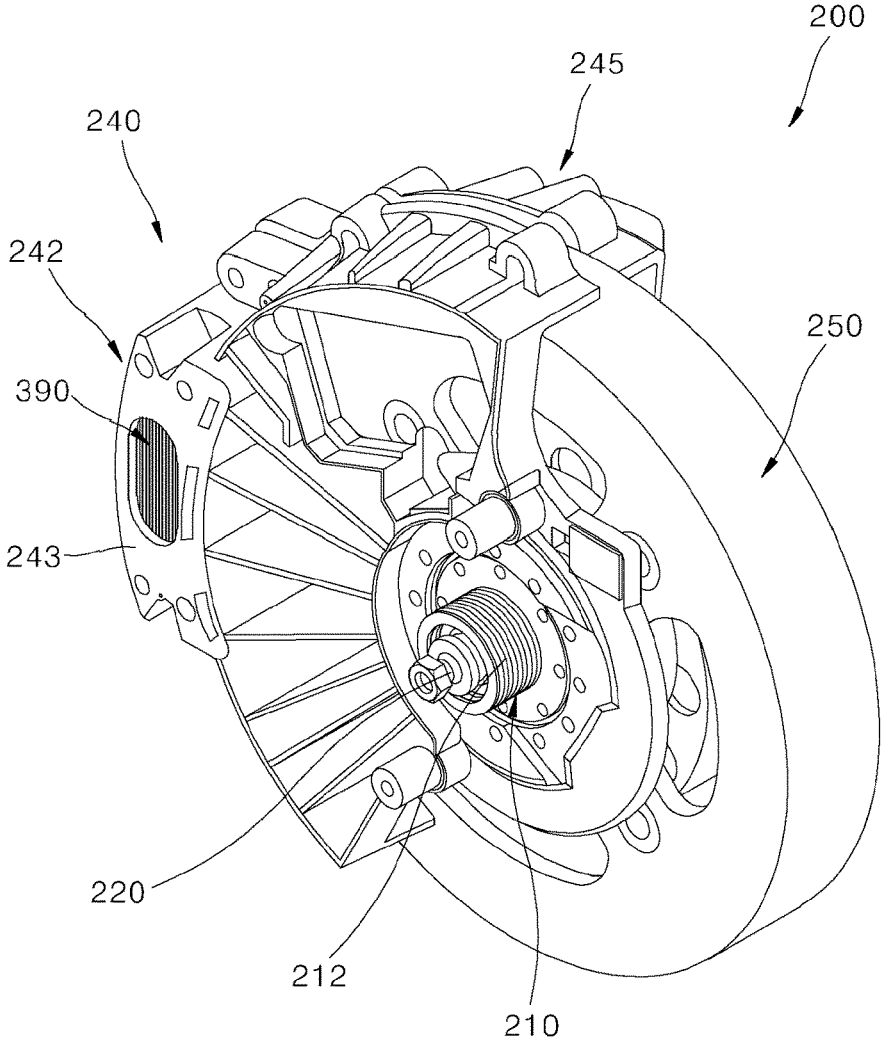
[Fig. 4]
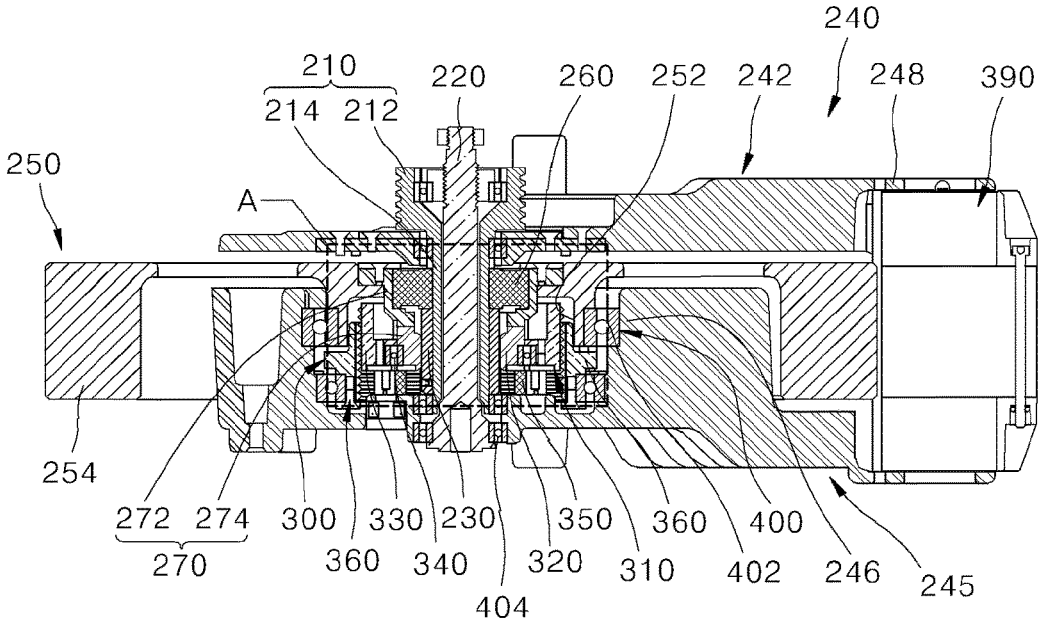

[Fig. 5]
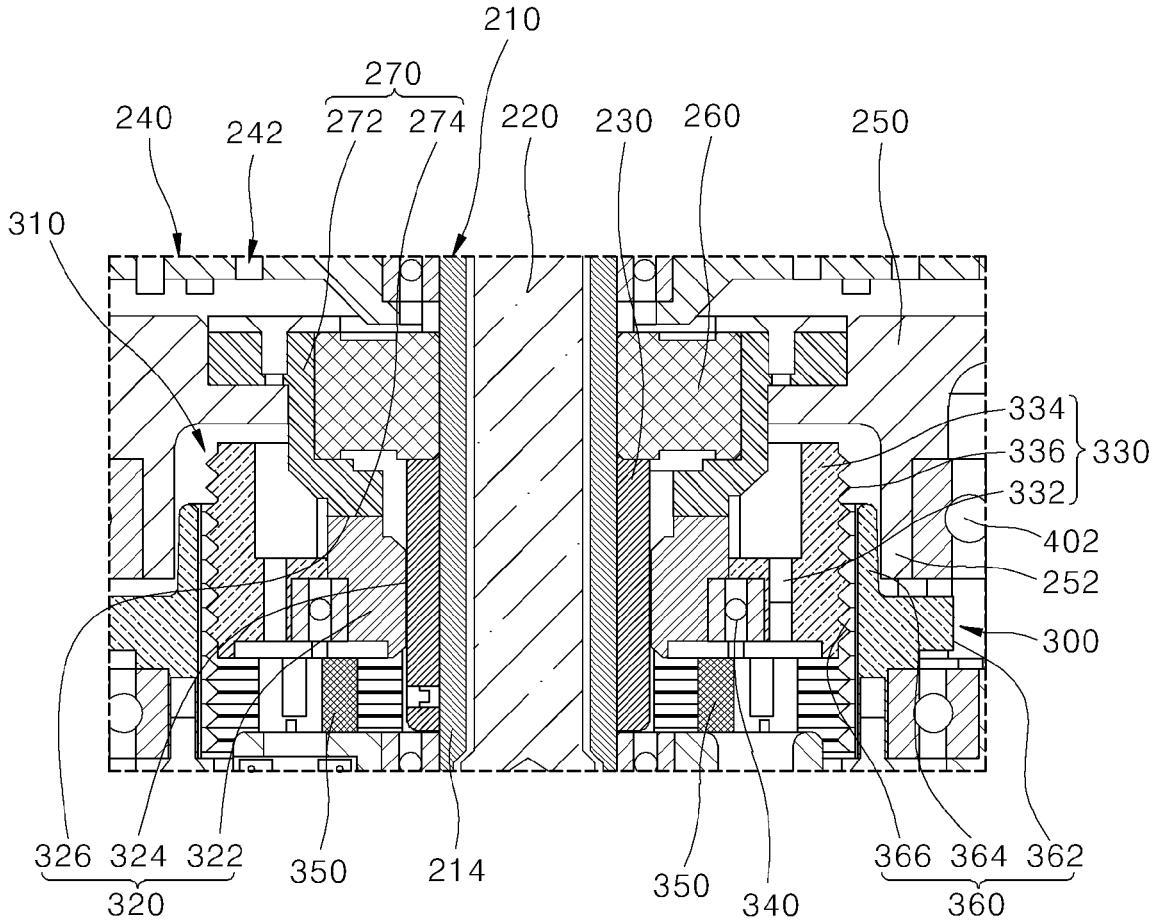

[Figure 6]
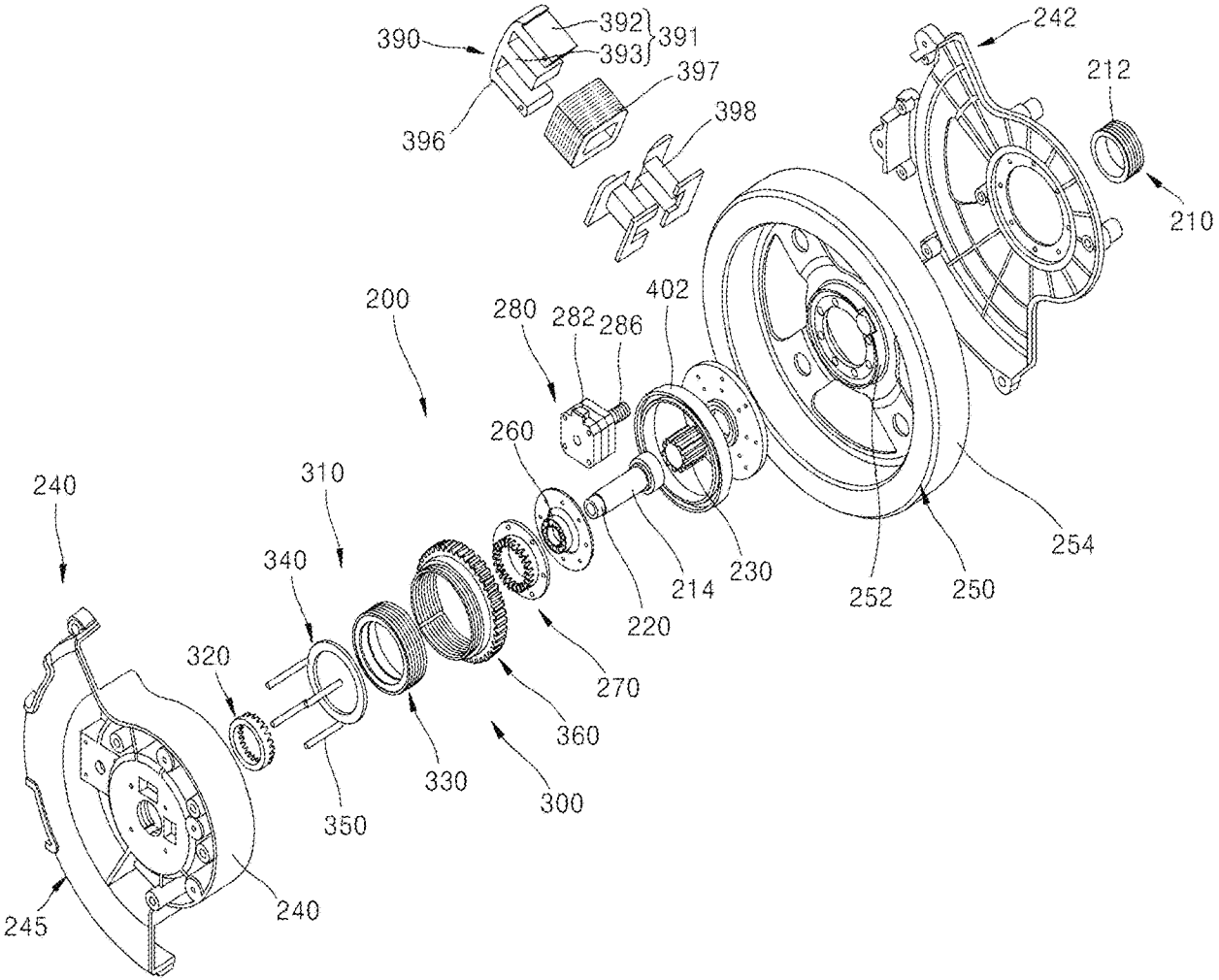

[Fig. 7]
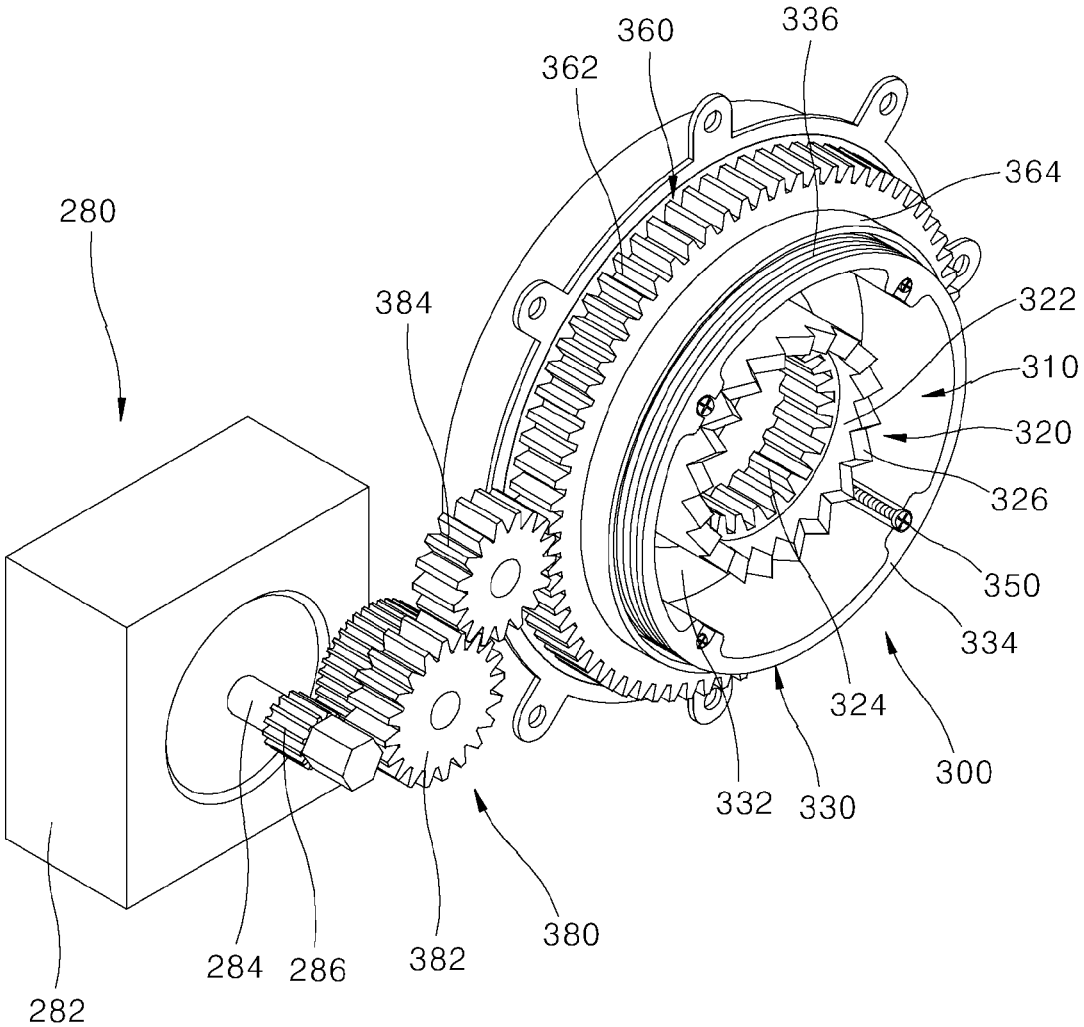

[Fig. 8]
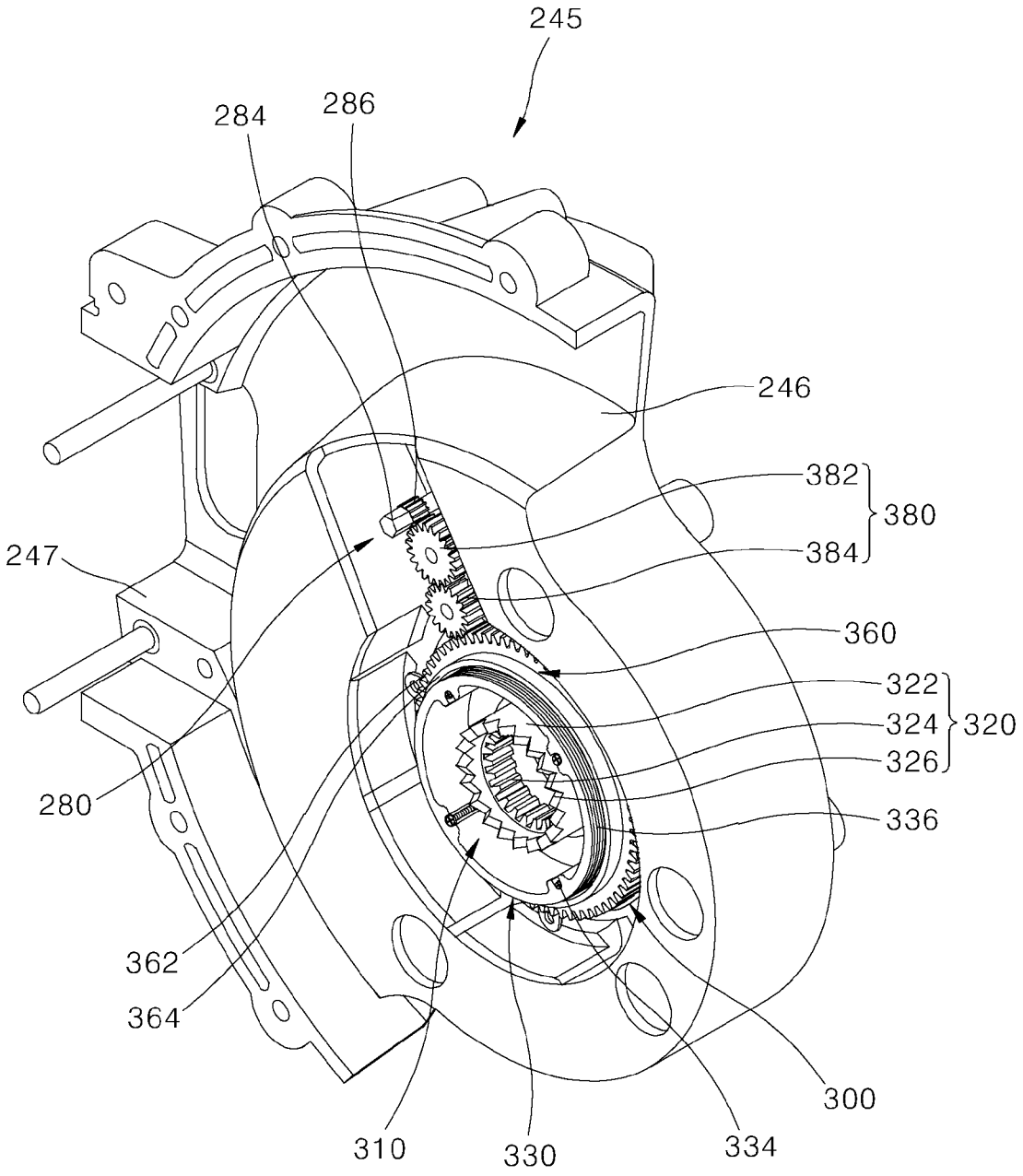

[Fig. 9]
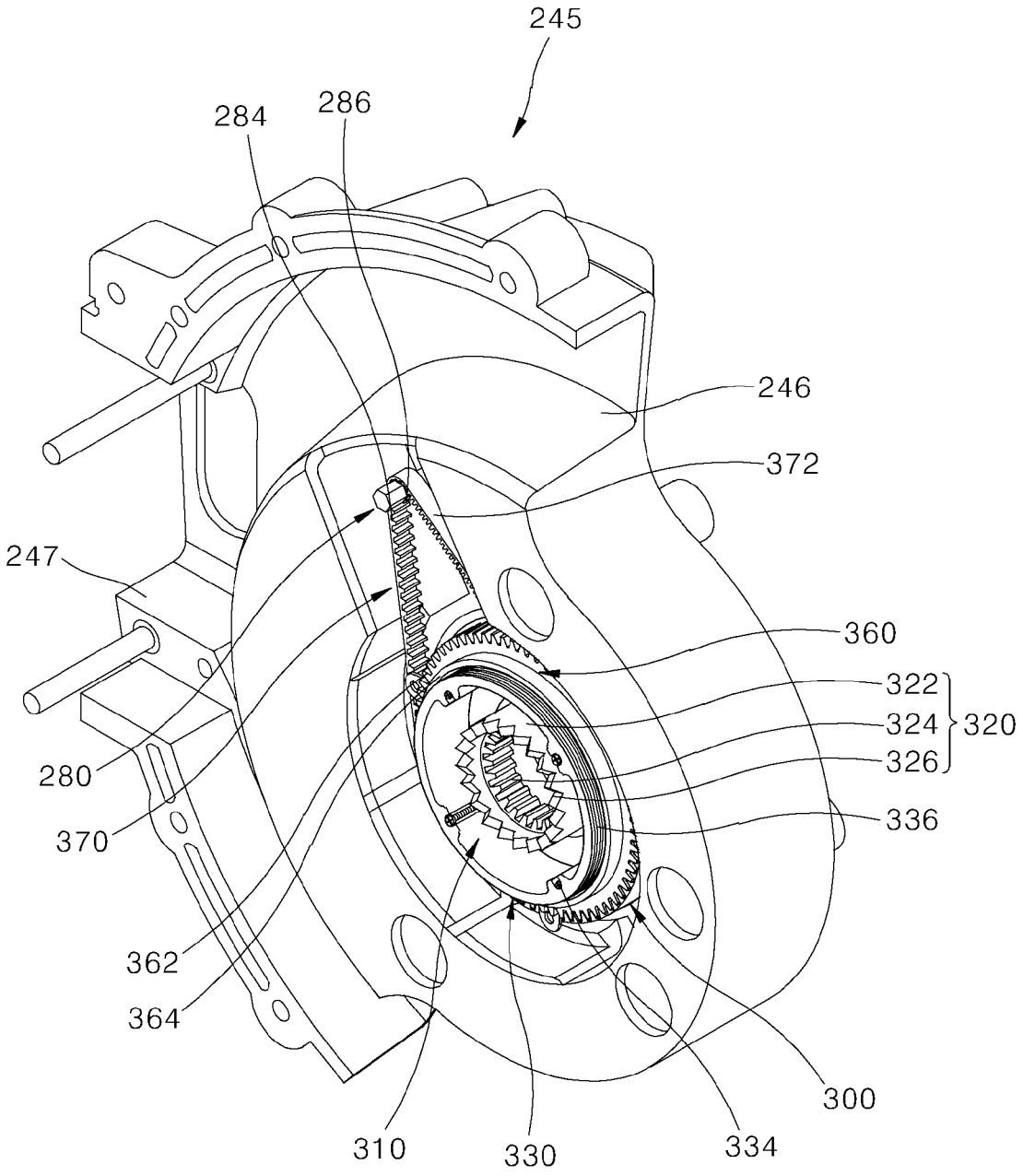

[Figure 10]
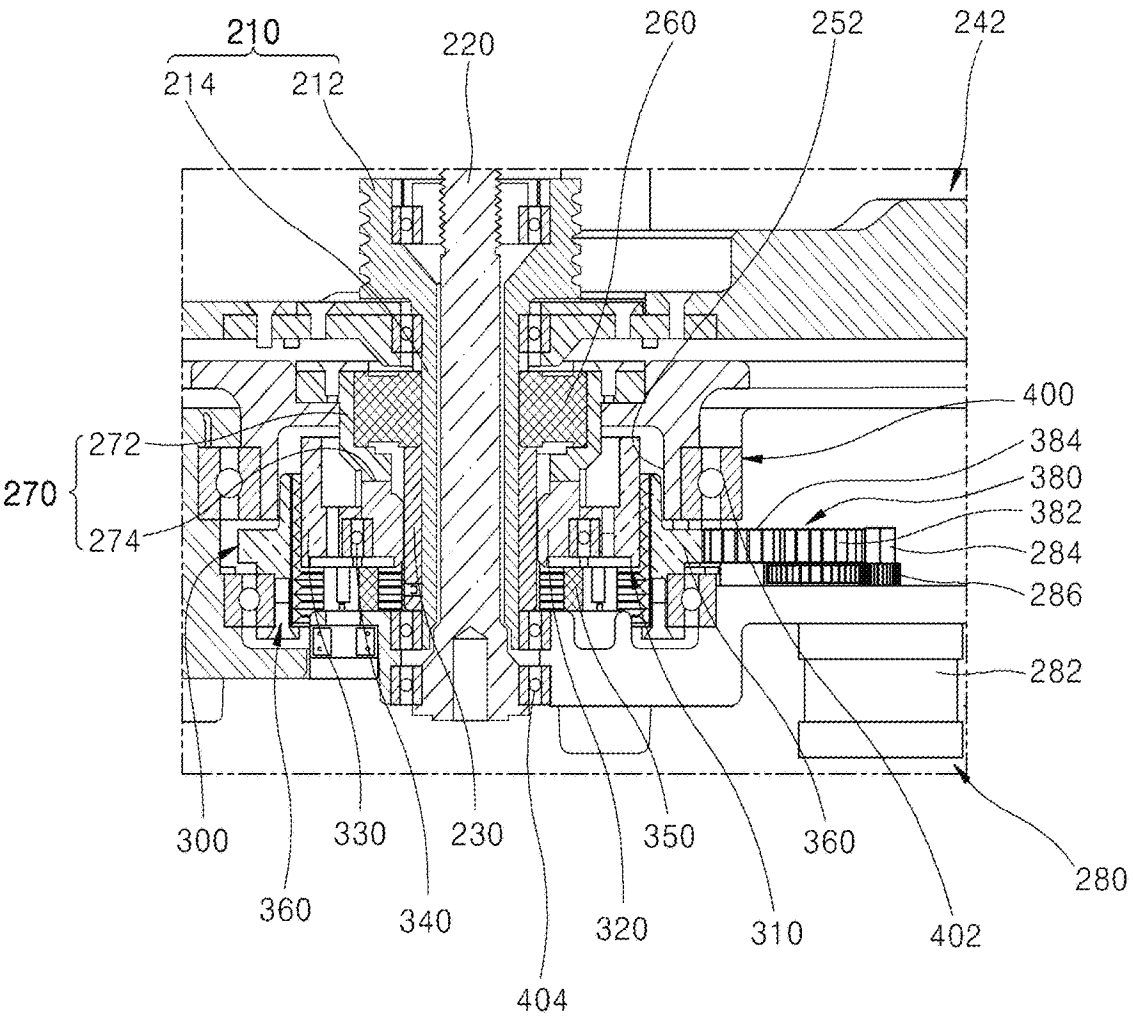

[Figure 11]
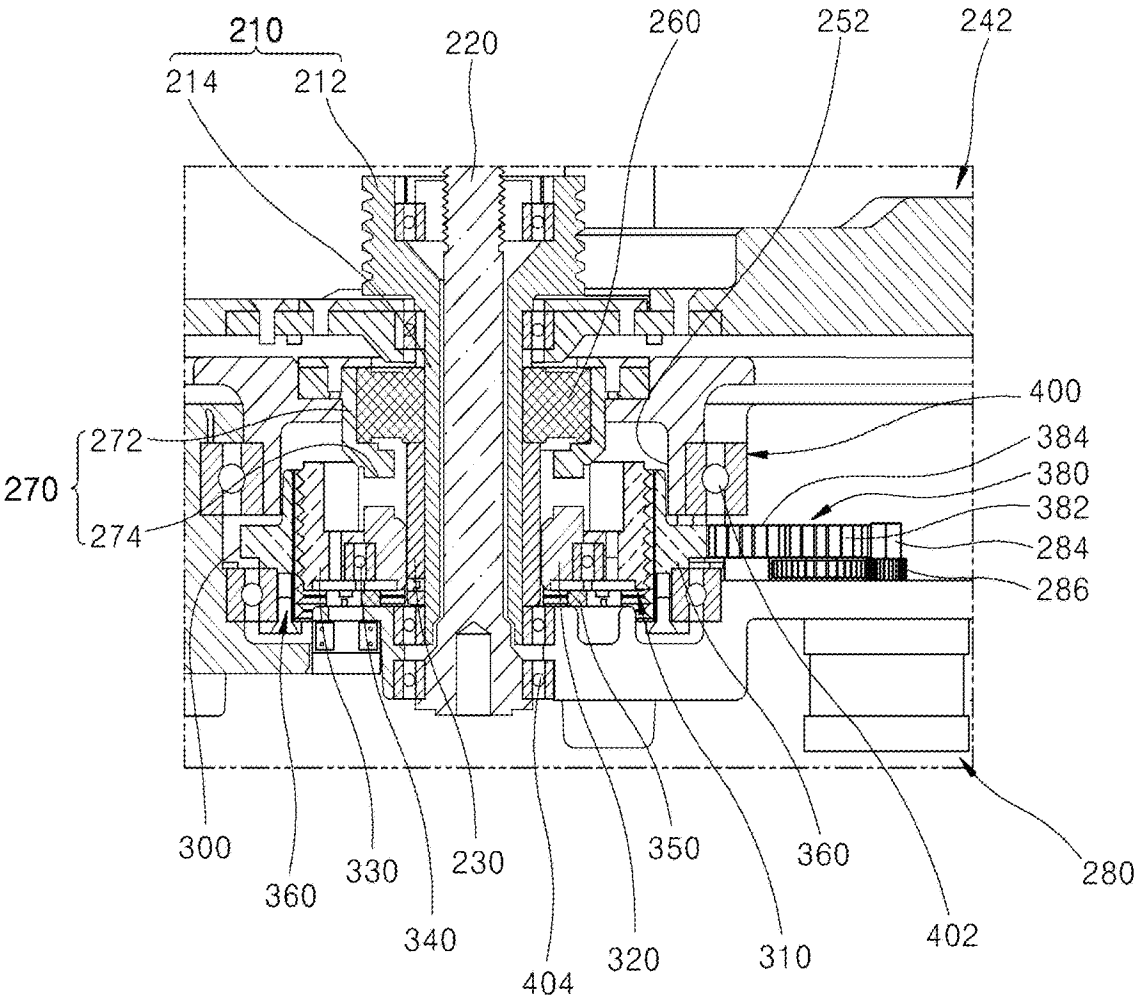

【Figure 12】
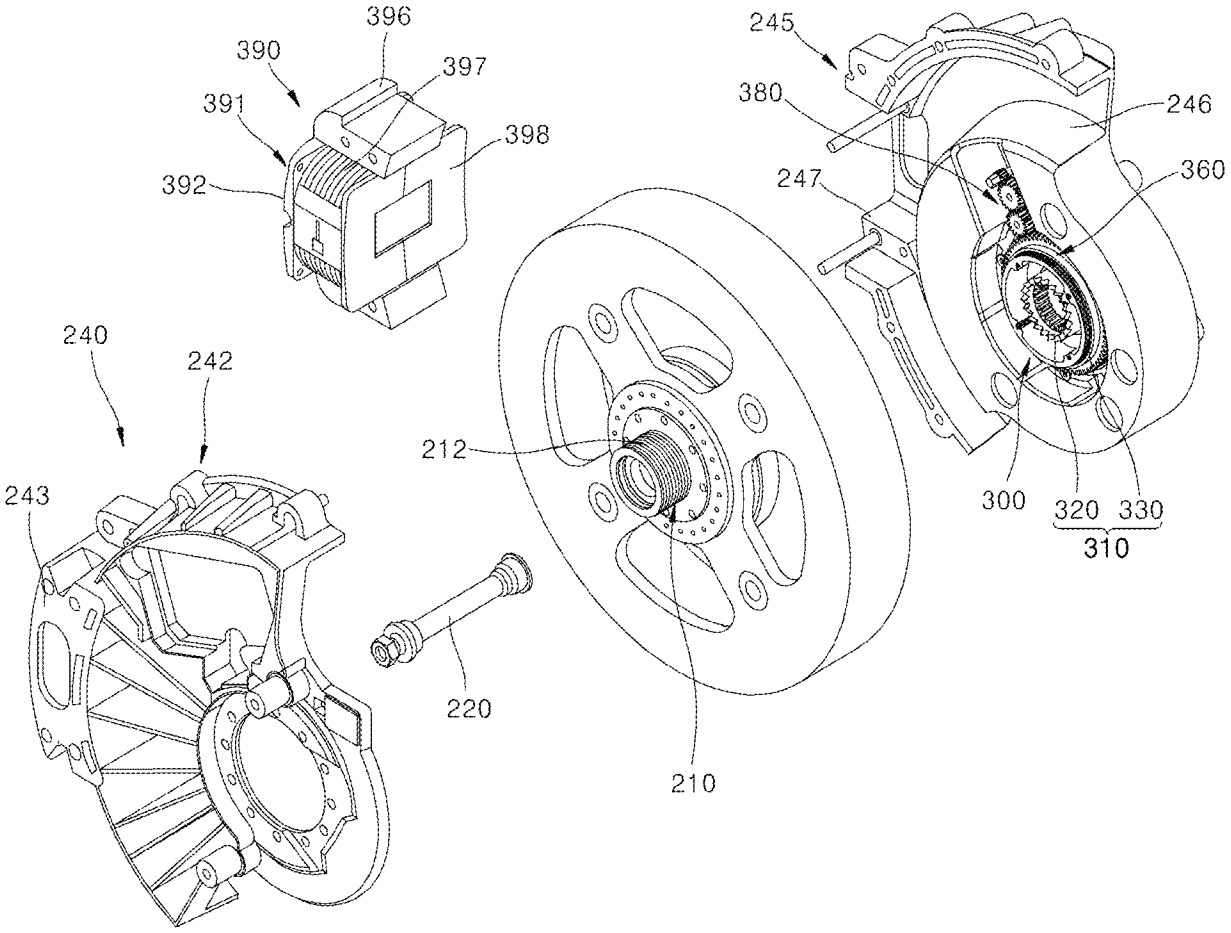

[Fig. 13]
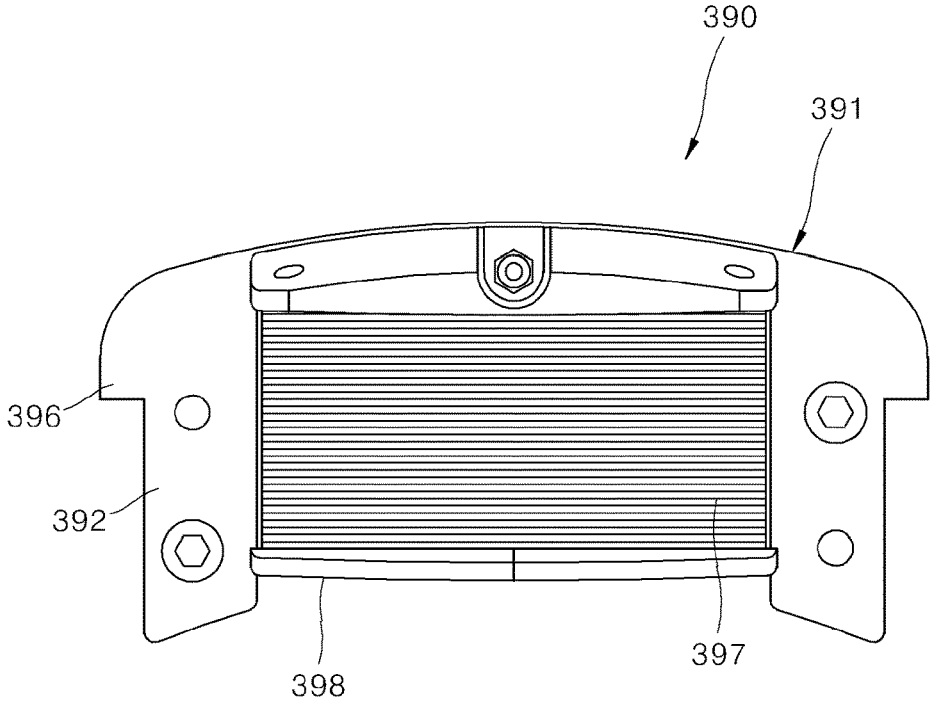
[Fig. 14]
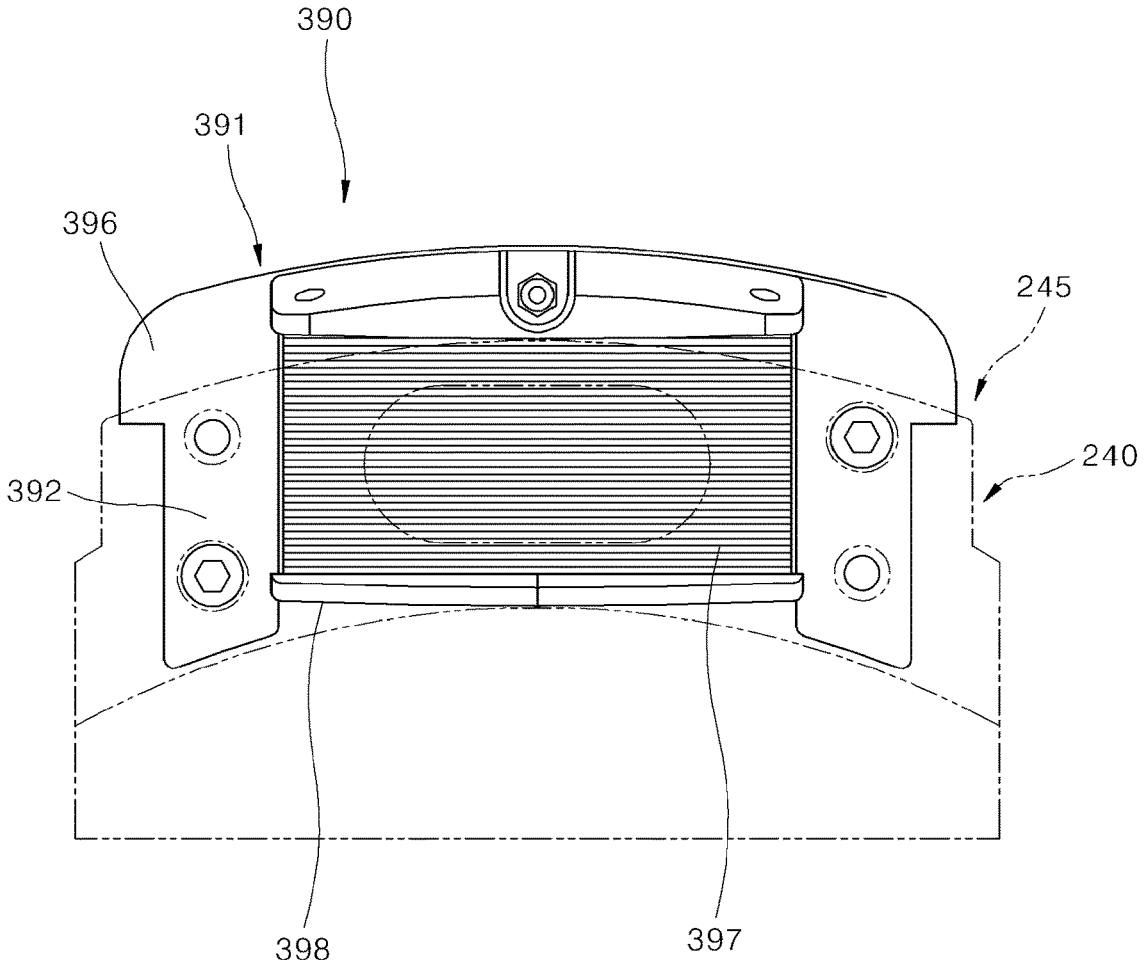

FREEWHEEL ADJUSTABLE WHEELS AND FITNESS BIKE THEREWITH

CROSS REFERENCE TO RELATED APPLICATIONS

This application is the National Phase of PCT International Application No. PCT/KR2023/009215, filed on Jun. 30, 2023, which claims priority under 35 U.S.C. 119 (a) to Patent Application No. 10-2022-0093477, filed in the Republic of Korea on Jul. 27, 2022, all of which are hereby expressly incorporated by reference into the present application.

TECHNICAL FIELD

The present disclosure relates to a freewheel adjustable wheel and a fitness bike therewith that automatically controls whether power of pedals is transferred to wheels at a time when the pedals rotate reversely.

BACKGROUND ART

Ordinarily, indoor exercise equipment for building muscles comprise weight training equipment for building muscles, and aerobic exercise equipment for improving functions of the cardiovascular system.

Aerobic exercise equipment is broadly categorized as a treadmill allowing users to walk or run on a continuous track, a fitness bike allowing users to build leg muscles and do cardio exercises based on a rotation of pedals, a stepper for producing the effect of climbing stairs, and the like.

Fitness bikes are installed in designated places, and their wheels rotate based on pedaling movements such that users can do exercise. Fitness bikes are categorized as a spinning bike for spinning exercises, and an indoor bike in which pedals rotate forward to rotate wheels like a bike.

A non-freewheel structure is applied to spinning bikes since users do exercise by pushing pedals, and a freewheel structure is applied to indoor bikes.

In the non-freewheel structure applied to a spinning bike, power is transferred to wheels to rotate the wheels in both cases where pedals rotate forward and reversely.

In the freewheel structure applied to an indoor bike, power is transferred to wheels in the case where pedals rotate forward, and is not transferred to wheel in the case where pedals rotate reversely.

In related arts, a spinning bike and an indoor bike have a different power transfer structure. Accordingly, users need to purchase a spinning bike and an indoor bike respectively for spinning and riding exercises, causing an increase in the costs of purchasing exercise equipment.

As a related art, a spinning bike is disclosed in KR Patent No. 10-1641429 (registered on Jul. 14, 2016).

DISCLOSURE OF INVENTION

Technical Problem

The objective of the present disclosure is to provide a freewheel adjustable wheel and a fitness bike therewith that uses a freewheel function selectively, based on the driving of a motor.

The objective of the present disclosure is to provide a freewheel adjustable wheel and a fitness bike therewith that allows a user to use a single exercise machine for a spinning exercise and a ride exercise.

The objective of the present disclosure is to provide a freewheel adjustable wheel and a fitness bike therewith in which a magnetic force generation part for adjusting a rotation speed of a rotation case rotating together with pedals is prevented from contacting the rotation case.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

Solution to Problem

According to the present disclosure, in a freewheel adjustable wheel and a fitness bike therewith, a driving part operates to move a movement gear part, controlling a freewheel operation.

Specifically, the movement gear part moves up and down, based on the operation of the driving part, to allow the gear of the movement gear part to engage with a rotation gear part, and power transferred to the rotation gear part is transferred to a first gear part through the movement gear part to rotate a rotation case, adjusting a freewheel mode and a non-freewheel mode.

According to the present disclosure, a magnetic force generation part is spaced from the rotation case.

Specifically, a core projection protruding outward from the magnetic force generation part is held at the outside of a fixation case, preventing the contact of the magnetic force generation part with the rotation case, caused by a magnetic force.

A freewheel adjustable wheel according to the present disclosure comprises a rotation gear part receiving power of a pedal part to rotate and being rotatably disposed outside a shaft, a spline gear being fixed to an outside of the rotation gear part and rotating together with the rotation gear part, a fixation case which rotatably supports the rotation gear part and a rotation of which is restricted, a rotation case receiving power of the rotation gear part to rotate and being rotatably disposed in the fixation case, a clutch bearing being disposed between the rotation gear part and the rotation case and transferring power at a time when the rotation gear part rotates forward, a first gear part having one side that is fixed to the rotation case and the other side that is disposed in a way that surrounds an outside of the clutch bearing to receive power thought the clutch bearing, a driving part being fixed to the fixation case and providing rotational power, and a movement gear part moving based on power of the driving part and operating in a non-freewheel mode where the movement gear part engages with the first gear part and in a freewheel mode where the movement gear part is spaced from the first gear part.

The movement gear part comprises an inner gear part engaging with the spline gear and rotating together with the rotation gear part, receiving power of the driving part and moving along the spline gear, and engaging with the first gear part and transferring power, an outer movement gear part being disposed outside the inner gear part and moving the inner gear part in a shaft direction of the shaft, based on a rotation, and a power transfer part transferring power of the driving part to the outer movement gear part, and rotating the outer movement gear part.

A fitness bike according to the present disclosure comprises a frame part supporting a saddle part and a handle part, a pedal part being disposed at a rotation disc that is disposed on a lateral surface of the frame part, a rotation gear part receiving power of the pedal part to rotate and being rotatably disposed outside a shaft, a spline gear being fixed to an outside of the rotation gear part and rotating together with the rotation gear part, a fixation case which rotatably supports the rotation gear part and a rotation of which is restricted, a rotation case receiving power of the rotation gear part to rotate and being rotatably disposed in the fixation case, a clutch bearing being disposed between the rotation gear part and the rotation case and transferring power at a time when the rotation gear part rotates forward, a first gear part having one side that is fixed to the rotation case and the other side that is disposed in a way that surrounds an outside of the clutch bearing to receive power thought the clutch bearing, a driving part being fixed to the fixation case and providing rotational power, and a movement gear part moving based on power of the driving part and operating in a non-freewheel mode where the movement gear part engages with the first gear part and in a freewheel mode where the movement gear part is spaced from the first gear part.

Advantageous Effects of Invention

According to the present disclosure, in a freewheel adjustable wheel and a fitness bike therewith, a movement gear part moves based on an operation of a driving part, and a freewheel mode and a non-freewheel mode are selectively used, ensuring ease of use of exercise equipment.

According to the present disclosure, users do not need an additional piece of exercise equipment, depending on the freewheel mode or the non-freewheel mode, resulting in a reduction in costs of purchasing exercise equipment.

According to the present disclosure, a magnetic force generation part is fixed in the state of being held at the outside of a fixation case, and the magnetic force generation part remains spaced from a rotation case, improving operational reliability in the fitness bike.

Specific effects are described along with the above-described effects in the section of detailed description.

BRIEF DESCRIPTION OF DRAWINGS

FIG. 1 is a perspective view showing a fitness bike that is provided with a freewheel adjustable wheel, in one embodiment.

FIG. 2 is a front view showing that a freewheel adjustable wheel is installed inside a fitness bike, in one embodiment.

FIG. 3 is a perspective view showing a freewheel adjustable wheel, in one embodiment.

FIG. 4 is a cross-sectional view showing a freewheel adjustable wheel, in one embodiment.

FIG. 5 is an enlarged cross-sectional view showing portion "A" illustrated in FIG. 4.

FIG. 6 is an exploded perspective view showing a freewheel adjustable wheel, in one embodiment.

FIG. 7 is a perspective view showing a driving part and a movement gear part, in one embodiment.

FIG. 8 is a perspective view showing that a power transfer part is comprised of a gear, in one embodiment.

FIG. 9 is a perspective view showing that a power transfer part is comprised of a power transfer belt, in one embodiment.

FIG. 10 is a front view showing that a first coupling gear and a second coupling gear engage with each other, in one embodiment.

FIG. 11 is a front view showing that a first coupling gear and a second coupling gear separate from each other, in one embodiment.

FIG. 12 is a perspective view showing a magnetic force generation part, a fixation case, and a rotation case, in one embodiment.

FIG. 13 is a perspective view showing a magnetic force generation part in one embodiment.

FIG. 14 is a view showing that a magnetic force generation part is mounted on a fixation case, in one embodiment.

BEST MODE FOR CARRYING OUT THE INVENTION

The above-described aspects, features and advantages are specifically described hereafter with reference to accompanying drawings such that one having ordinary skill in the art to which the present disclosure pertains can embody the technical spirit of the disclosure easily. In the disclosure, detailed description of known technologies in relation to the subject matter of the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components are not to be limited by the terms. Certainly, a first component can be a second component, unless stated to the contrary.

When any one component is described as being "in the upper portion (or lower portion)" or "on (or under)" another component, any one component can be directly on (or under) another component, and an additional component can be interposed between the two components.

When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary.

The singular forms "a", "an" and "the" are intended to include the plural forms as well, unless explicitly indicated otherwise. It is to be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereafter, described are a freewheel adjustable wheel 200, and a fitness bike 1 provided with the freewheel adjustable wheel 200 in one embodiment.

FIG. 1 is a perspective view showing a fitness bike 1 that is provided with a freewheel adjustable wheel 200, in one embodiment, FIG. 2 is a front view showing that a freewheel adjustable wheel 200 is installed inside a fitness bike 1, in one embodiment, FIG. 3 is a perspective view showing a freewheel adjustable wheel 200, in one embodiment, FIG. 4 is a cross-sectional view showing a freewheel adjustable wheel 200, in one embodiment, and FIG. 5 is an enlarged cross-sectional view showing portion "A" illustrated in FIG. 4.

As illustrated in FIGS. 1 to 5, the operation mode of a fitness bike 1 in one embodiment is switched to a freewheel mode and a non-freewheel mode, based on the operation of a driving part.

The fitness bike 1 uses a one-way clutch bearing 260 that transfers power based on a forward rotation but does not transfer power based on a reverse rotation. Accordingly, the fitness bike 1 transfers power only at a time of a forward rotation. In the case where the fitness bike 1 operates in a freewheel mode, power is transferred only by the clutch bearing 260.

Additionally, the fitness bike 1 operates in a non-freewheel mode since power is transferred to a rotation case 250 even in the case of a reverse rotation of a pedal part 40, based on engagement of a movement gear part 300 moved by a driving part 280 with a first gear part 270.

In the case where the fitness bike 1 operates in a freewheel mode, power is transferred through the clutch bearing 260, thereby realizing low-noise driving and embodying a fitness bike having a less thickness and size than a conventional fitness bike. In the case where the fitness bike 1 operates in a non-freewheel mode, a second gear part 320 provided at the movement gear part 300 engages with the first gear part 270 fixed to the rotation case 250, to transfer power.

The fitness bike 1 may be modified in various different forms within the technical scope in which the driving part 280 operates to move the movement gear part 300, thereby controlling a freewheel mode operation and a non-freewheel mode operation. A freewheel adjustable wheel 200 is installed inside the fitness bike 1, and the driving part 280 is disposed at the freewheel adjustable wheel 200.

The fitness bike 1 in one embodiment may comprise at least any one of a frame part 10, a belt member 20, a disc part 30, a pedal part 40, a rotation support shaft 50, a base part 60, a seat housing part 70, a handle 80, a display part 90, a seat post 100, a seat 110 and a freewheel adjustable wheel 200.

Additionally, the fitness bike 1 transfers power by using a gear or a belt, when the mode of the fitness bike 1 switches to a freewheel mode and a non-freewheel mode. Further, the fitness bike 1 has a separation space between the rotation case 250 and the magnetic force generation part 390, to ensure the rotation operation of the rotation case 250 easily.

The mode of the fitness bike 1 in one embodiment switches to a freewheel mode and a non-freewheel mode easily, based on the operation of driving the driving part 280, in the case where the pedal part 40 rotates forward or reversely. Accordingly, the training method of the fitness bike 1 may change according to user requirements, and various exercise effects may be produced by one piece of exercise equipment, and a variety of contents may be applied depending on different exercises.

The frame part 10 supporting the seat 110 and the handle 80 may be modified in various different forms within the technical scope in which the frame part 10 forms the body of the fitness bike 1. The frame part 10 in one embodiment comprises an outer frame 12, an inner frame 14, and a side frame 16.

Both lateral surfaces of the outer frame 12 are open, and the outer frame is disposed at the upper side of the base part 60 and fixed to the seat post 100. The freewheel adjustable wheel 200, a rotation disc and an inner disc are installed inside the outer frame 12.

The outer frame 12 is shaped into an approximate "ㄴ", and the inner frame 14 is installed inside the outer frame 12. The inner frame 14 supports the freewheel adjustable wheel 200 inside the frame part 10. The inner frame 14 is formed in a way that a plurality of beam members is connected, and one side of the inner frame 14 is fixed to the seat 110 post, and the other side supports a shaft 220 of the freewheel adjustable wheel 200.

The side frame 16 is coupled to both of the open lateral surfaces of the outer frame 12. The side frame 16 is shaped into a plate and detachably coupled to both of the lateral surfaces of the outer frame 12, making it easy to repair and exchange components of the fitness bike 1 and the like.

The frame part 10 may have various structures, depending on the load distribution and structure of the fitness bike 1.

The rotation support shaft 50 is horizontally installed in the frame part 10. The rotation support shaft 50 connects to a disc part 30 having a circle plate shape. A disc part 30 in one embodiment comprises a rotation disc and an inner disc 34.

Both sides of the rotation support shaft 50 may connect to the inner disc. Both sides of the rotation support shaft 50 in one embodiment connect to the central portion of the inner disc.

A rotation disc 32 having a circular plate shape is fixed to the outside of the inner disc 34, and the pedal part 40 is detachably disposed at the rim of the rotation disc 32. The pedal part 40 is fastened to the rotation disc 32 while forming a right angle with the rotation disc 32. Accordingly, as the user pushes the pedal part 40, the rotation disc and the inner disc rotate around the rotation support shaft 50.

The rotation disc 32 is shaped into a circular panel. The side frame 16 has a circle-shaped hole for installing the rotation disc 32. Since the rotation disc 32 and the inner disc 34 are installed in the circular hole provided at the side frame 16, to shield components inside the frame part 10.

Thus, the rotation disc 32 may block a user, an infant and a companion pet from approaching to the inside of the frame part 10, and prevent a user, an infant and a companion pet from being caught by a component inside the frame part 40 when the pedal part 40 rotates.

Since the belt member 20 is hung at the outer edge of the inner disc, the belt member rotates a rotation gear part 210 provided at the freewheel adjustable wheel 200, based on a rotation of the inner disc. One side of the belt member 20 connects to the inner disc, and the other side of the belt member 20 connects to a pulley member 212 of the rotation gear part 210.

The pedal part 40 is rotatably disposed at the rotation disc that is mounted on the lateral surface of the frame part 10. The pedal part 40 is rotated and coupled to a fastening groove provided at the rotation disc 32, to be coupled to the rotation disc 32. Additionally, the rotation disc rotates together with the pedal part 40.

The rotation support shaft 50 is installed in a way that the rotation support shaft 50 passes through the central portion of the rotation disc 32 and the inner disc 34 that are rotated by pedals. The rotation disc 32 and the inner disc 34 serve as a driving wheel, and are connected to the pulley member 212 of the rotation gear part 210 described hereafter by a belt or a chain and the like. As the user pushes the pedal part 40, the rotation disc 32 and the inner disc 34 rotate, and as the inner disc 34 rotates, the belt member 20 and the rotation gear part 210 rotate.

The base part 60 is disposed at the lower side of the frame part 10, to support the frame part 10. The base part 60 is spaced from the lower side of the frame part 10 and installed in a plate shape. The base part 60 may be formed in different shapes.

The seat housing part 70 is disposed at the upper side of the base part 60. The seat housing part 70 is shaped into a square pipe, and elongated to the upper side of the base part 60 and penetrates the inside of the frame part 10. The lower side of the seat housing part 70 is fixed to the base part 60. Additionally, since the frame part 10 is fixed to the seat housing part 70, the frame part 10 is spaced from the base part 60 and disposed at an upper side.

The seat housing part 70 may be disposed to incline in the up-down direction of the frame part 10. The seat 110 housing part is disposed between the rotation support shaft 50 and the shaft 220. The seat housing part 70 may be shaped into a polygonal pipe or a circular pipe.

A handle 80 that can be gripped by the user is disposed at one side of the frame part 10. A display part 90 is disposed at the upper side of the frame part 10 that is adjacent to the handle 80, to check an operation state and an exercise record of the fitness bike 1 easily.

The display part 90 may output exercise information such as a speed, a rotation load and the like of the fitness bike 1 on a screen.

The seat post 100 is disposed at the upper side of the seat housing part 70, and supports the lower side of the seat 110. The seat post 100 may be installed in the seat housing part 70 in a way that the height of the seat post 100 is adjustable. Certainly, the seat post 100 may be fixed to the inside of the seat housing part 70. The cross section of the seat post 100 may vary depending on the shape of the seat housing part 70.

Since the seat post 100 is installed in the seat housing part 70 in a way that the height of the seat post 100 is adjustable, the height of the seat 110 may be adjusted properly based on the height or body measurements and exercise trends of the user.

In the fitness bike 1 of the present disclosure, the freewheel adjustable wheel 200 may be disposed at a rear side or a front side with respect to the rotation support shaft 50. Depending on the installation position of the freewheel adjustable wheel 200, the shape of the frame part 10 varies. Additionally, the positions of the rotation support shaft 50 and the shaft 220 vary.

FIG. 6 is an exploded perspective view showing a freewheel adjustable wheel 200, in one embodiment. As illustrated in FIGS. 3 to 6, the freewheel adjustable wheel 200 comprises a rotation gear part 210, a shaft 220, a spline gear 230, a fixation case 240, a rotation case 250, a clutch bearing 260, a first gear part 270, a driving part 280, a movement gear part 300, a magnetic field generation part 390, and a bearing part 400.

The rotation gear part 210 may receive power of the pedal part 40 to rotate, and be modified in various different forms within the technical scope in which the rotation gear part 210 is rotatably disposed outside the shaft 220. The rotation gear part 210 in one embodiment comprises a pulley member 212 and a rotation body 214.

The pulley member 212 connects to the belt member 20, and receives power of the pedal part 40 to rotate. Since a gear is provided along the outer circumference of the pulley member 212, a slip of the pulley member 212 hung outside the pulley member 212 may be suppressed. The pulley member 212 is disposed outside the fixation case 240, and receives power of the pedal part 40 through the belt member 20.

The rotation body 214 is elongated to the inside of the fixation case 240 from the pulley member 212, and rotates together with the pulley member 212. The rotation body 214 in one embodiment is shaped into a pipe.

The rotation gear part 210 is installed in the fixation case 240 and the rotation case 250 such that the rotation gear part 210 receives power of the pedal part 40 and rotates. The shaft 220 is installed in the rotation gear part 210. Both sides of the shaft 220 are coupled to the inner frame 14, in a way that the shaft 220 does not rotate. The rotation gear part 210 is fitted to the outside of the shaft 220. The rotation gear part 210 is installed in a way that the rotation gear part 210 and the shaft 220 form a concentric circle. A shaft bearing 404 is disposed between the shaft 220 and the rotation gear part 210. Accordingly, when the rotation gear part 210 is rotated by the belt member 20, the shaft 220 does not rotate.

The shaft 220 is installed horizontally while passing through the inside of the rotation gear part 210, and fixed to the frame part 10. The shaft 220 in one embodiment is shaped into a rod, and is installed in a way that the shaft 220 penetrates the rotation center of a case part.

The spline gear 230 may be fixed to the outside of the rotation gear part 210, and modified in various different forms within the technical scope in which the spline gear 230 rotates together with the rotation gear part 210. The spline gear 230 in one embodiment is shaped into a circular pipe that is coupled to the outside of the rotation gear part 210, is fixed to the outside of the rotation gear part 210 and rotates together with the rotation gear part 210.

Additionally, since a gear is formed on the outer surface of the spline gear 230 in the up-down direction, the second gear part 320 of the movement gear part 300, engaging with the outside of the spline gear 230, moves along the spline gear 230 linearly.

The fixation case 240 may be modified in various different forms within the technical scope in which the fixation case 240 rotatably supports the rotation gear part 210 and the rotation of the fixation case 240 is restricted. The fixation case 240 is fixed to the frame part 10 of the fitness bike 1, such that the rotation of the fixation case 240 is restricted, and the rotation case 250 is rotatably installed inside the fixation case 240.

The shaft 220 is mounted on the frame part 10 after penetrating the fixation case 240 and the rotation case 250, and the rotation gear part 210 is disposed outside the shaft 220. The rotation gear part 210 is also installed in a way that the rotation gear part 210 penetrates the fixation case 240 and the rotation case 250.

The fixation case 240 in one embodiment comprises a first fixation case 242, and a second fixation case 245. The first fixation case 242 and the second fixation case 245 are installed to surround the outside of the rotation case 250, with the rotation case 250 therebetween.

The magnetic force generation part 390 is disposed between the first fixation case 242 and the second fixation case 245. The magnetic force generation part 390 generates a magnetic force to adjust the rotation speed or rotation load of the rotation case 250 comprising iron.

A fixation panel is disposed at the edge of the first fixation case 242, and disposed in a position where the fixation panel faces one lateral surface of the magnetic force generation part 390. The second fixation case 245 facing the fixation panel is provided with a fixation block forming a step.

The magnetic force generation part 390 is bolt-fastened and fixed to the fixation block, and is spaced a predetermined distance apart from the rotation case 250.

The rotation case 250 may receive power of the rotation gear part 210 to rotate, and be modified in various different forms within the technical scope in which the rotation case 250 is rotatably disposed at the fixation case 240. The rotation case 250 in one embodiment rotates together with the first gear part 270 in contact with the clutch bearing 260. Accordingly, the rotation case 250 receives rotational power produced by a forward rotation, through the clutch bearing 260.

The rotation gear part 210 and the shaft 220 are disposed in a way that the rotation gear part 210 and the shaft 220 penetrate the center of the rotation case 250. The rotation case 250 is shaft-coupled to the rotation gear part 210 and rotates in a freewheel mode and a non-freewheel mode. The rotation gear part 210 coupled to the rotation center of the rotation case 250.

In the case where the rotation gear part 210 rotates forward in the freewheel mode, the rotation case 250 rotates forward, and in the case where the rotation gear part 210 rotates reversely, the rotation case 250 does not rotate. In the case where the rotation gear part 210 rotates reversely in the freewheel mode, the rotation case 250 does not rotate, and the rotation gear part 210 idles in the rotation case 250.

In the case where the rotation gear part 210 rotates forward or reversely in the non-freewheel mode, the rotation case 250 rotates. Since power provided through the rotation gear part 210 is transferred to the first gear part 270 through the movement gear part 300 in the non-freewheel mode, the rotation case 250 rotates together with the rotation gear part 210.

The second fixation case 245 of the fixation case 240 is disposed in the open portion of the rotation case 250 while supporting the driving part 280. The second fixation case 245 may be modified in various different forms within the technical scope in which the second fixation case 245 is disposed to shield the open portion of the rotation case 250 and the rotation of the second fixation case 245 is restricted.

The rotation case 250 in one embodiment comprises an outer case 254 and a rotation rib 252. The rotation case 250 may be entirely shaped into a circular plate. The rotation gear part 210 penetrates the central portion of the rotation case 250. The rotation case 250 is provided with an outer case 254 that is disposed at the circumference of the rotation case 250 and is elongated along the circumferential shape of the rotation case 250.

The outer case 254 protruding perpendicularly from the body of the rotation case 250 is disposed in a ring shape, and faces the outside of the edge of the fixation case 240.

The rotation rib 252 is installed inside the outer case 254. The rotation rib 252 and the outer case 254 are disposed in a ring shape, and the diameter of the rotation rib 252 is less than the diameter of the outer case 254. Additionally, a wheel bearing part 402 is disposed between the outer case 254 and the rotation rib 252. The rotation rib 252 protrudes toward the second fixation case 245 from the body of the rotation case 250.

The wheel bearing part 402 is disposed between the second fixation case 245 and the rotation rib 252.

An inner rib 246 elongated from the second fixation case 245 is elongated in a ring shape. The diameter of the inner rib 246 is greater than the diameter of the rotation rib 252, and less than the diameter of the outer case 254. Accordingly, the wheel bearing part 402 is disposed between the inner rib 246 and the rotation rib 252. In the case where the rotation case 250 rotates in the state where the rotation of the fixation case 240 is restricted, friction is reduced by the wheel bearing part 402 disposed between the rotation case 250 and the fixation case 240.

The clutch bearing 260 may be disposed between the rotation gear part 210 and the rotation case 250, and modified in various different forms within the technical scope in which the clutch bearing transfers power to the rotation case 250 as the rotation gear part 210 rotates forward.

A ring-shaped mounting groove may be formed in the central portion of the rotation case 250, and the clutch bearing 260 is mounted in the mounting groove. The mounting groove forms a concentric circle with the rotation gear part 210 and the rotation case 250. The clutch bearing 260 is a one way bearing that allows a one way rotation of the rotation gear part 210 only. The clutch bearing 260 transfers power to the first gear part 270 fixed to the rotation case 250, to rotate the rotation gear part 210 and the rotation case 250 together, at a time when the rotation gear part 210 rotates forward. In the case where the rotation gear part 210 rotates reversely, the rotation gear part 210 only rotates, and the clutch bearing 260 does not transfer power to the rotation case 250.

The clutch bearing 260 rotates the rotation case 250 only in the case where the rotation gear part 210 rotates forward, and enables the freewheel mode of the rotation case 250. The clutch bearing 260 have a structure in which a bearing (not illustrated) is interposed between an inner wheel (not illustrated) and an outer wheel (not illustrated). For the clutch bearing 260, the bearing restricts the inner wheel and the outer wheel, and the inner wheel and the outer wheel rotate integrally, at a time when the rotation gear part 210 rotates forward. Further, the bearing releases the inner wheel and the outer wheel from the restriction at a time when the rotation gear part 210 rotates reversely. The bearing may have various shapes such as a sphere shape, a circular rod shape and the like. The clutch bearing 260 may be modified in various different forms within the technical scope in which the clutch bearing 260 rotates the rotation case 250 only in the case where the rotation gear part 210 rotates forward.

One side of the first gear part 270 is fixed to the rotation case 250, and the other side of the first gear part 270 is disposed to surround the outside of the clutch bearing 260. The first gear part 270 receives rotational power through the clutch bearing 260, at a time when the rotation gear part 210 rotates forward.

The first gear part 270 in one embodiment comprises a first gear body 272 and a first coupling gear 274. The first gear body 272 is fixed to the rotation case 250 while surrounding the outside of the clutch bearing 260. One end of the first gear body 272 is fixed to the rotation case 250, and the other end is elongated to a second gear part 320 described hereafter. Since the first gear body 272 is disposed in contact with the outside of the clutch bearing 260, the first gear body 272 receives rotational power through the clutch bearing 260 to rotate together with the rotation case 250.

The other side of the first gear body 272 is open toward the movement gear part 300, and has a cylindrical shape.

The first coupling gear 274 forms a gear in the end portion of the first gear body 272 facing the movement gear part 300 and forms a gear engaging with a second coupling gear 326 that is provided at the movement gear part 300. The first coupling gear 274 forms a gear along the circumferential shape thereof. Additionally, the teeth of a first coupler incline in one rotation direction.

The second coupling gear 326 of the second gear part 320, engaging with the first coupling gear 274, also forma a gear along the circumferential shape thereof. Additionally, the teeth of a second coupler incline in the other rotation direction, to engage with the first coupling gear 274.

At a time when the rotation gear part 210 rotates reversely, power is transferred while the first coupling gear 274 engages with the second coupling gear 326, and at a time when the rotation gear part 210 rotates forward, power is not transferred since the first coupling gear 274 does not engage with the second coupling gear 326.

FIG. 7 is a perspective view showing a driving part 280 and a movement gear part 300, in one embodiment.

As illustrated in FIGS. 6 and 7, the driving part 280 may be fixed to the fixation case 240, and modified in various different forms within the technical scope in which the driving part supplies rotational power and moves the movement gear part 300. The driving part 280 in one embodiment comprises a driving body 282 and an output shaft 284. A power gear 286 is disposed around the output shaft 284.

The driving body 282 uses a motor, and the output shaft 284 protruding outward from the driving body 282 rotates based on the operation of the driving body 282. The power gear 286 disposed along the outer circumference of the output shaft 284 is elongated in a ring shape, and is provided with a linear gear 324 elongated in the lengthwise direction of the output shaft 284. The power gear 286 rotating together with the output shaft 284 may rotate engaging with a gear of a power transfer part 370, 380, or rotate engaging with a power transfer belt 372.

An inner gear part 310 of the movement gear part 300 moves up and down based on the operation of the driving part 280. Power of the power gear 286 that rotates based on the operation of the driving part 280 is transferred to the first gear part 270 through the movement gear part 300 to rotate the rotation case 250, the mode of the fitness bike may be adjusted to the freewheel mode and the non-freewheel mode. Further, according to the present disclosure, the fitness bike operates in the freewheel mode and non-freewheel mode, reducing costs of purchasing exercise equipment.

FIG. 8 is a perspective view showing that a power transfer part 380 is comprised of a gear, in one embodiment.

As illustrated in FIGS. 6 to 8, the movement gear part 300 moves based on power of the driving part 280, and operates in the non-freewheel mode where the movement gear part engages with the first gear part 270, and in the free wheel mode where the movement gear part separates from the first gear part 270.

The movement gear part 300 moves based on power of the driving part 280, and operates in the non-freewheel mode where the movement gear part engages with the first coupling gear 274 of the first gear part 270, and in the free wheel mode where the movement gear part 300 separates from the first coupling gear 274 of the first gear part 270.

In the case where the movement gear part 300 separates from the first coupling gear 274, the power of rotating the pedal part 40 forward is transferred to the rotation case 250 through the rotation gear part 210, the clutch bearing 260 and the first gear part 270, to rotate the rotation case 250. Additionally, since the power of rotating the pedal part 40 reversely rotates the spline gear 230 and the second gear part 320 only, rotational power is not transferred to the rotation case 250. Accordingly, the rotation of the clutch bearing 260 synchronizes with the rotation of the rotation case 250, only when the rotation gear part 210 rotates forward, and the freewheel adjustable wheel 200 operates in the freewheel mode.

In the case where the rotation of the clutch bearing 260 synchronizes with the rotation of the rotation case 250, based on the engagement of the first coupling gear 274 of the movement gear part 300 with the first coupling gear 274 of the first gear part 270, the freewheel adjustable wheel 200 operates in the non-freewheel mode. In the non-freewheel mode, power of the pedal part 40 is transferred to the rotation gear part 21, the spline gear 230, the second gear part 320 of the inner gear part 310, the first gear part 270 and the rotation case 250 consecutively.

The movement gear part 300 in one embodiment comprises an inner gear part 310, an outer movement gear part 360, and a power transfer part 370, 380.

The inner gear part 310 may engage with the spline gear 230 and rotate together with the rotation gear part 210, and receive power of the driving part 280 and move linearly along the spline gear 230, and may be modified in various different forms within the technical scope in which the inner gear part 310 engages with the first gear part 270 and transfers power.

The second gear part 320 engages with the spline gear 230 and receives power of the rotation gear part 210. The second gear part 320 is disposed outside the spline gear 230, and moves linearly along the spline gear 230. The second gear part 320 moves toward the first gear part 270 and engages with the first gear part 270 or moves away from the first gear 270.

The second gear part 320 in one embodiment comprises a second gear body 322, a linear gear 324 and a second coupling gear 326.

The second gear body 322 is elongated in a ring shape, and the linear gear 324 engaging with the spline gear 230 is disposed along the inner circumference of the second gear body 322. The second gear body 322 is shaped into a pipe, and disposed outside the spline gear 230. The linear gear 324 is disposed along the inner circumference of the second gear body 322, and coupled to the outside side of the spline gear 230.

The second coupling gear 326 forms teeth along the outer circumference of the second gear body 322 facing the first gear. The second coupling gear 326 is formed in the end portion of the second gear body 322 and disposed one after another along the circumferential direction.

In the state where the first coupling gear 274 and the second coupling gear 326 separate from each other, forward rotational force through the clutch bearing 260 is transferred to the rotation case 250 through the first gear part 270. Additionally, in the state where the second coupling gear 326 contacts the first coupling gear 274, reverse rotational force transferred to the rotation gear part 210 is transferred to the first gear part 270 through the movement gear part 300.

A groove part for installing a connection bearing 340 along the outer circumference of the second gear body 322 may be provided.

The inner movement gear part 330 may be disposed between the second gear part 320 and the outer movement gear part 360, and modified in various different forms within the technical scope in which the inner movement gear part 330 moves the second gear part 320 in the shaft direction of the shaft 220. The inner movement gear part 330 gear-connects to the outer movement gear part 360, and moves linearly together with the second gear part 320, based on the rotation of the outer movement gear part 360.

The rotation of the inner movement gear part 330 is restricted by a guide bar 350. Accordingly, the inner movement gear part 330 moves linearly along the guide bar 350 at a time when the outer movement gear part 360 rotates.

The inner movement gear part 330 in one embodiment comprises an inner movement body 332, an inner extension part 334, and an outer movement gear 336.

The inner movement body 332 is elongated along the outer circumference of the second gear part 320, in a rig shape, and connected to the second gear part 320 by the connection bearing 340. The inner movement body 332 is disposed outside the second gear body 322, and elongated along the outer circumference of the second gear body 322.

The inner movement body 332 and the second gear body 322 are connected by the connection bearing 340. Accordingly, the second gear body 322 disposed inside the inner movement body 332, the rotation of which is restricted, is rotatably installed.

The inner extension part 334 is elongated from the edge of the inner movement body 332 axially/in the shaft direction. The inner extension part 334 is shaped into a pipe, and the outer movement gear 336 is disposed on the outer surfaces of the inner extension part 334 and the inner movement body 332.

A gear of the outer movement gear 336, engaging with a gear provided inside the outer movement gear part 360, is disposed on the outer surface of the inner extension part 334. The outer movement gear 336 is shaped into a male screw thread and engages with an inner rotation gear 366 of the outer movement gear part 360.

The connection bearing 340 is disposed between the second gear part 320 and the inner movement gear part 330. Accordingly, the second gear part 320 and the inner movement gear part 330 move together in the shaft direction of the shaft 220, and the second gear part 320 engaging with the spline gear 230 rotates together with the spline gear 230.

Further, the rotation of the inner movement gear part 330 is restricted by the guide bar 350, and the movement of the inner movement gear part 330 is allowed only in the lengthwise direction of the guide bar 350.

The guide bar 350 is shaped into a rod that is fixed to the fixation case 240, contacts the inner movement gear part 330, and guides a linear movement of the inner movement gear part 330. A plurality of guide bars 350 is provided, penetrates the inner movement body 332 or is inserted into the groove part provided on the inner surface of the inner movement body 332, and restricts the rotation of the inner movement body 332.

The outer movement gear part 360 may be disposed outside the inner gear part 310, and may be modified in various different forms within the technical scope in which the outer movement gear part 360 moves the inner gear part 310 in the shaft direction of the shaft 220, based on a rotation. The outer movement gear part 360 in one embodiment comprises a body gear 362, a movement gear body 364, and an inner rotation gear 366.

The body gear 362 connects to the power transfer part 370, 380 to receive power, has a gear on the outer circumferential surface thereof, and is elongated in a ring shape.

The movement gear body 364 is fixed to the inside of the body gear 362 and disposed in a way that surrounds the outside of the inner gear part 310. The movement gear body 364 is shaped into a pipe, and rotatably disposed outside the inner movement gear part 330.

The inner rotation gear 366 forms a gear engaging with the gear that is provided at the outside of the inner gear part 310, on the inner surface of the movement gear body 364. The inner rotation gear 366 engages with the outer movement gear 336, and the inner movement gear part 330, the rotation of which is restricted based on the rotation of the inner rotation gear 366, moves linearly along the guide bar 350.

The power transfer part 370, 380 may be modified in various different forms within the technical scope in which the power transfer part 370, 380 transfers power of the driving part 280 to the outer movement gear part 360 and rotates the outer movement gear part 360.

FIG. 9 is a perspective view showing that a power transfer part 370 is comprised of a power transfer belt 372, in one embodiment.

As illustrated in FIG. 9, the power transfer part 370 may use a power transfer belt 372 shaped into a belt that connects the power gear 286 provided at the driving part 280 and the body gear 362 provided outside the outer movement gear part 360. Since a plurality of gears is provided at the inside of the power transfer belt 372, the gears engage with the gears provided at the outsides of the body gear 362 and the power gear 286, to prevent a slip.

When the power transfer belt 372 is used, the number of components decreases, and an operation structure is simplified further than when a gear is used to transfer power. Additionally, the force of transferring power may vary depending on the tension of the power transfer belt 372. Thus, components capable of adjusting the tension of the power transfer belt 372 may be additionally provided.

As illustrated in FIG. 8, a power transfer part 380 in another example may transfer power of the driving part 280 to the outer movement gear part 360 through a plurality of gears. The power transfer part 380 in one embodiment may comprise a first transfer gear 382 and a second transfer gear 384.

The first transfer gear 382 engages with the power gear 286 provided at the driving part 280 and rotates, and is provided with gears having a different diameter in two stages. The second transfer gear 384 engages with the first transfer gear 382 and the body gear 362 provided at the outside of the outer movement gear part 360, to transfer power of the first transfer gear 382 to the body gear 362.

FIG. 12 is a perspective view showing a magnetic force generation part 390, a fixation case 240, and a rotation case 250, in one embodiment, FIG. 13 is a perspective view showing a magnetic force generation part 390 in one embodiment, and FIG. 14 is a view showing that a magnetic force generation part 390 is mounted on a fixation case 240, in one embodiment.

As illustrated in FIGS. 12 to 14, the magnetic force generation part 390 may be detachably disposed at the fixation case 240, and may be modified in various different forms within the technical scope in which the magnetic force generation part 390 generates a magnetic force to adjust the rotation speed of the rotation case 250. The magnetic force generation part 390 in one embodiment comprises a core part 391, a core projection 396, a coil member 397 and a bobbin 398.

The core part 391 is fixed to the fixation case 240, such that movement of the core part 391 is restricted. The core part 391 is bolt-coupled to the fixation case 240. Since the core part 391 is bolt-coupled and fixed to a fixation block provided at the second fixation case 245, the movement of the coil member 397 may be restricted by a magnetic force. The core part 391 in one embodiment comprises a core body 392 and a core rib 393.

The core body 392 is fixed to the fixation case 240 and is spaced from the rotation case 250, forming a "⊏" cross section. The core rib 393 protrudes inward from the core body 392, and the coil member 397 is wound around the outside of the core rib 393. The core body 392 in which the core rib 393 is installed form a "⊏" cross section.

The core projection 396 is shaped into a projection that protrudes toward the outside of the core part 391 and is held outside the fixation case 240. Since the core projection 396 protruding to the outside of the magnetic force generation part 390 is held at the outside the fixation case 240, the contact of the magnetic force generation part 390 with the rotation case 250, caused by a magnetic force, may be prevented. The core projection 396 protrudes from both lateral surfaces of the core part 392 and is held at the outside the fixation case 240.

The coil member 397 is wound around the core part 391 and generates a magnetic force. The coil member 397 in one embodiment is disposed in a way that the coil member 397 is wound around the outside of the core rib 393.

The bobbin 398 may be coupled to the outside of the core rib 393, and the coil member 397 may be wound around the outside of the bobbin 398.

The magnetic force generation part 390 is fixed in the state of being held at the outside of the fixation case 240, and remains separated from the rotation case 250, thereby ensuring improvement in the operational reliability of the fitness bike 1.

The bearing part 400 rotatably supporting components that rotates at the freewheel adjustable wheel 200 is provided with a plurality of bearings. The bearing part 400 in one embodiment comprises a wheel bearing part 402 and a shaft bearing 404.

Since the wheel bearing part 402 is disposed between the rotation rib 252 of the rotation case 250 and the fixation case 240, the wheel bearing part 402 reduces friction between the fixation case 240 the rotation of which is restricted, and the rotation case 250 which rotates.

A shaft 220 bearing is disposed between the shaft 220 and the rotation gear part 210 and reduces friction that is generated when the shaft 220 rotates.

Hereafter, the operational states of a freewheel adjustable wheel 200 and a fitness bike 1 therewith, in one embodiment, are described with reference to the accompanying drawings.

[Non-Freewheel Mode]

FIG. 10 is a front view showing that a first coupling gear 274 and a second coupling gear 326 engage with each other, in one embodiment.

As illustrated in FIG. 10, in the case where the driving part 280 operates and then an axial force shaft rotates, the power gear 286 rotates the first transfer gear 382 and the second transfer gear 384, as the power gear 286 rotates together with the axial force shaft. As the outer movement gear part 360 engaging with the second transfer gear 384 rotates, the inner movement gear part 330 inside the outer movement gear part 360 moves toward the first gear part 270 while the inner movement gear part 330 rotates.

As the inner movement gear part 330 moves, the second coupling gear 326 of the second gear part 320 engages with the first coupling gear 274 of the first gear part 270. In the case where the pedal part 40 rotates reversely, in the state where the second coupling gear 326 engages with the first coupling gear 274, power transferred to the rotation gear part 210 is transferred to the first gear part 270 through the spline gear 230 and the second gear part 320 to rotate the rotation case 250.

Additionally, in the case where the pedal part 40 rotates forward, power is transferred to the first gear part 270 through the clutch bearing 260, and the rotation case 250 rotates forward together with the first gear part 270. Accordingly, the freewheel adjustable wheel 200 and the fitness bike 1 therewith operate in the non-freewheel mode.

[Freewheel Mode]

FIG. 11 is a front view showing that a first coupling gear 274 and a second coupling gear 326 separate from each other, in one embodiment.

As illustrated in FIG. 11, in the case where the driving part 280 operates and the axial force shaft rotates, the power gear 286 rotates the first transfer gear 382 and the second transfer gear 382 while the power gear 286 rotates together with the axial force shaft. As the outer movement gear part 360 engaging with the second transfer gear 384 rotates, the inner movement gear part 330 moves away from the first gear part 270, while the inner movement gear part 330 inside the outer movement gear part 360 rotates.

As the inner movement gear part 330 moves, the second gear part 320 is spaced from the first gear part 270. In the case where the second coupling gear 326 is spaced from the first coupling gear 274, power of the rotation gear part 210 is not transferred to the rotation case 250 through the first gear part 270, as the pedal part 40 rotates reversely.

In the case where the pedal part 40 rotates forward, power is transferred to the first gear part 270 through the clutch bearing 260, and the rotation case 250 rotates forward together with the first gear part 270. Thus, the freewheel adjustable wheel 200 and the fitness bike 1 therewith operate in the freewheel mode.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the range of the disclosure though not explicitly described in the description of the embodiment.

The invention claimed is:

1. A freewheel adjustable wheel, comprising:

a rotation gear part receiving power of a pedal part to rotate, and being rotatably disposed outside a shaft;

a spline gear being fixed to an outside of the rotation gear part, and rotating together with the rotation gear part;

a fixation case which rotatably supports the rotation gear part and a rotation of which is restricted;

a rotation case receiving power of the rotation gear part to rotate, and being rotatably disposed in the fixation case;

a clutch bearing being disposed between the rotation gear part and the rotation case, and transferring power at a time when the rotation gear part rotates forward;

a first gear part having one side that is fixed to the rotation case, and the other side that is disposed in a way that surrounds an outside of the clutch bearing to receive power thought the clutch bearing;

a driving part being fixed to the fixation case, and providing rotational power; and a movement gear part moving based on power of the driving part, and operating in a non-freewheel mode where the movement gear part engages with the first gear part, and in a freewheel mode where the movement gear part is spaced from the first gear part.

2. The freewheel adjustable wheel of claim 1, the movement gear part, comprising:

an inner gear part engaging with the spline gear and rotating together with the rotation gear part, receiving power of the driving part and moving along the spline gear, and engaging with the first gear part and transferring power;

an outer movement gear part being disposed outside the inner gear part, and moving the inner gear part in a shaft direction of the shaft, based on a rotation; and a power transfer part transferring power of the driving part to the outer movement gear part, and rotating the outer movement gear part.

3. The freewheel adjustable wheel of claim 2, wherein the power transfer part a belt-shaped power transfer belt connecting a power gear that is provided at the driving part and a body gear that is provided outside the outer movement gear part.

4. The freewheel adjustable wheel of claim 2, the power transfer part, comprising:

a first transfer gear rotating while engaging with the power gear that is provided at the driving part; and a second transfer gear engaging with the first transfer gear and a body gear that is provided outside the outer movement gear part, and transferring power of the first transfer gear to the body gear.

5. The freewheel adjustable wheel of claim 2, the inner gear part, comprising:

a second gear part engaging with the spline gear and receiving power of the rotation gear part, moving toward the first gear part, and engaging with the first gear part;

an inner movement gear part being disposed between the second gear part and the outer movement gear part, and moving the second gear part in the shaft direction of the shaft; and a guide bar being shaped into a rod that is fixed to the fixation case, contacting the inner movement gear part, and guiding a linear movement of the inner movement gear part.

6. The freewheel adjustable wheel of claim 5, the second gear part, comprising:

a second gear part being elongated in a ring shape, and having a linear gear that engages with the spline gear and is disposed along an inner circumference of the second gear part; and a second coupling gear forming teeth along an outer circumference of the second gear body that faces the first gear.

7. The freewheel adjustable wheel of claim 5, wherein a connection bearing is disposed between the second gear part and the inner movement gear part, and the second gear part and the inner movement gear part move together in the shaft direction of the shaft.

8. The freewheel adjustable wheel of claim 5, the inner movement gear part, comprising:

an inner movement body being elongated in a ring shape, along an outer circumference of the second gear part, and being connected to the second gear part by a connection bearing;

an inner extension part being elongated from an edge of the inner movement body axially/in a shaft direction; and a gear of an outer movement gear, which engages with a gear at an inside of the outer movement gear part, being disposed on an outer surface of the inner extension part.

9. The freewheel adjustable wheel of claim 2, the outer movement gear part, comprising:

a body gear connecting to the power transfer part and receiving power, having a gear on an outer circumferential surface thereof, and being elongated in a ring shape;

a movement gear body being fixed to an inside of the body gear, and being disposed in a way that surrounds an outside of the inner gear part; and an inner rotation gear forming a gear, which engages with a gear provided outside the inner gear part, on an inner circumferential surface of the movement gear body.

10. The freewheel adjustable wheel of claim 1, the first gear part, comprising:

a first gear body being fixed to the rotation case while surrounding the outside of the clutch bearing, and being open toward the movement gear part; and a first coupling gear forming a gear in an end portion of the first gear body facing the movement gear part, and engaging with the second coupling gear that is provide at the movement gear part.

11. The freewheel adjustable wheel of claim 10, wherein in a state where the first coupling gear and the second coupling gear are spaced from each other, forward rotational power through the clutch bearing is transferred to the rotation case through the first gear part, and in a state where the second coupling gear contacts the first coupling gear, reverse rotational power transferred to the rotation gear part is transferred to the first gear part through the movement gear part.

12. The freewheel adjustable wheel of claim 1, wherein the freewheel adjustable wheel further comprises a magnetic force generation part being detachably installed in the fixation case, and generating a magnetic force to adjust a rotation speed of the rotation case.

13. The freewheel adjustable wheel of claim 12, the magnetic force generation part, comprising:

a core part being fixed to the fixation case;

a coil projection protruding to an outside of the core part and being held at an outside the fixation case; and a core member being wound around the core part.

14. The freewheel adjustable wheel of claim 13, the core part, comprising:

a core body being fixed to the fixation case, being spaced from the rotation case, and having a "⊏" cross section; and a core rib protruding inward from the core body, and having the coil member wound round a outside of the core rib.

15. A fitness bike, comprising:

a frame part supporting a saddle part and a handle part;

a pedal part being disposed at a rotation disc that is disposed on a lateral surface of the frame part;

a rotation gear part receiving power of the pedal part to rotate, and being rotatably disposed outside a shaft;

a spline gear being fixed to an outside of the rotation gear part, and rotating together with the rotation gear part;

a fixation case which rotatably supports the rotation gear part and a rotation of which is restricted;

a rotation case receiving power of the rotation gear part to rotate, and being rotatably disposed in the fixation case;

a clutch bearing being disposed between the rotation gear part and the rotation case, and transferring power at a time when the rotation gear part rotates forward;

a first gear part having one side that is fixed to the rotation case, and the other side that is disposed in a way that surrounds an outside of the clutch bearing to receive power thought the clutch bearing;

a driving part being fixed to the fixation case, and providing rotational power; and a movement gear part moving based on power of the driving part, and operating in a non-freewheel mode where the movement gear part engages with the first gear part, and in a freewheel mode where the movement gear part is spaced from the first gear part.

16. The fitness bike of claim 15, wherein the fitness bike further comprises a magnetic force generation part being detachably installed in the fixation case, and generating a magnetic force to adjust a rotation speed of the rotation case.

17. The fitness bike of claim 16, the magnetic force generation part, comprising:

a core part being fixed to the fixation case;

a coil projection protruding to an outside of the core part and being held at an outside the fixation case; and a core member being wound around the core part.

18. The fitness bike of claim 15, the movement gear part, comprising:

an inner gear part engaging with the spline gear and rotating together with the rotation gear part, receiving power of the driving part and moving along the spline gear, and engaging with the first gear part and transferring power;

an outer movement gear part being disposed outside the inner gear part, and moving the inner gear part in a shaft direction of the shaft, based on a rotation; and a power transfer part transferring power of the driving part to the outer movement gear part, and rotating the outer movement gear part.

19. The fitness bike of claim 18, the inner gear part, comprising:

a second gear part engaging with the spline gear and receiving power of the rotation gear part, moving toward the first gear part, and engaging with the first gear part;

an inner movement gear part being disposed between the second gear part and the outer movement gear part, and moving the second gear part in the shaft direction of the shaft; and a guide bar being shaped into a rod that is fixed to the fixation case, contacting the inner movement gear part, and guiding a linear movement of the inner movement gear part.

20. The fitness bike of claim 18, the outer movement gear part, comprising:

a body gear connecting to the power transfer part and receiving power, having a gear on an outer circumferential surface thereof, and being elongated in a ring shape;

a movement gear body being fixed to an inside of the body gear, and being disposed in a way that surrounds an outside of the inner gear part; and an inner rotation gear forming a gear, which engages with a gear provided outside the inner gear part, on an inner circumferential surface of the movement gear body.

* * * * *